US008297559B1

(12) United States Patent
Voegeli et al.

(10) Patent No.: US 8,297,559 B1
(45) Date of Patent: Oct. 30, 2012

(54) HAND THROW MECHANISM FOR IN-TIE SWITCH MACHINE

(75) Inventors: Norwin Voegeli, Ponte Vedra Beach, FL (US); Robert H. Walker, Ponte Vedra Beach, FL (US)

(73) Assignee: Siemens Industry, Inc., Alpharetta, GA (US)

( * ) Notice: Subject to any disclaimer, the term of this patent is extended or adjusted under 35 U.S.C. 154(b) by 0 days.

(21) Appl. No.: 13/106,365

(22) Filed: May 12, 2011

(51) Int. Cl.
*B61L 5/00* (2006.01)

(52) U.S. Cl. ..... 246/410; 411/393; 411/397

(58) Field of Classification Search ..... 246/393, 246/396, 397, 402, 404, 406, 410, 411
See application file for complete search history.

(56) References Cited

U.S. PATENT DOCUMENTS 3,418,462 A * 12/1968 Wilson et al. ..... 246/393
3,652,849 A * 3/1972 Kleppick ..... 246/393
3,691,371 A * 9/1972 Hylen ..... 246/393
6,138,959 A * 10/2000 Wydotis et al. ..... 246/406
6,471,163 B1 * 10/2002 Brushwood ..... 246/410
7,267,304 B2 * 9/2007 Scheer ..... 246/410
2006/0208137 A1 * 9/2006 Scheer ..... 246/393
* cited by examiner

*Primary Examiner* — Jason C Smith

(57) ABSTRACT

A hand throw mechanism for an in-tie switch machine having a drive element which serves to move switch points from a first end point to a second end point. The mechanism includes an elongated hand throw arm having a first coupling element that includes a first lower mating surface and a first upper mating surface. The mechanism also includes a gear set having an output shaft for moving the drive element. The gear set additionally includes a second coupling element having a second lower mating surface for engaging the first upper mating surface and a second upper mating surface for engaging the first lower mating surface to thus couple the first and second coupling elements. Rotation of the hand throw arm through an angle of approximately 180 degrees then causes rotation of the output shaft to thus move the driving element and ultimately the switch points. The mechanism also includes a thrust element having a raised portion wherein rotation of the thrust element urges the raised portion against the first coupling element to separate the first and second coupling elements and disengage the throw arm.

20 Claims, 7 Drawing Sheets

HAND THROW MECHANISM FOR IN-TIE SWITCH MACHINE

FIELD OF THE INVENTION

This invention relates to a hand throw mechanism for an in-tie switch machine, and more particularly, to a hand throw mechanism for an in-tie switch machine which includes couplings for engaging a hand throw arm with a gear set adapted to move a drive element in the in-tie switch machine.

BACKGROUND OF THE INVENTION

Railroad networks frequently include track switches which are used to direct trains between one of two possible destination tracks. A track switch includes a pair of switching rails, commonly referred to as switch points, which are linked to each other and are moveable between two end positions. This enables alignment of the switch points to allow continued movement on the current track when in one end position and allows movement to another stationary track when in the other end position.

A motorized switch machine is frequently used to move the switch points between the normal and reverse positions. With a conventional switch machine, several components used in moving the switch points such as connecting and operating rods and others are located in between and around adjoining railroad ties at a switch location. This is a disadvantage when performing tamping operations on a railroad track. In such operations, a tamping machine is used to pack or tamp track ballast, such as rocks, under the railroad ties and rails in order to provide a stable base for the railroad tracks and to reduce track maintenance and train vibrations. However, machine tamping cannot be performed around the area of a conventional switch machine since access to the track ballast is obstructed by the various switch machine components located between and around the railroad ties.

An alternate type of switch machine is an in-tie switch machine. In this type of switch machine, many of the various mechanisms and components used in moving the switch points, such as a switch machine, pawl lock, throw and detector rods and others are housed in a single compartment which also serves as a railroad tie. As a result, the areas between and around the railroad ties are cleared of these components and machine tamping operations in these areas may be performed. In-tie switch machines also increase the overall rigidity of a switch and help protect the switch machine components from damage thus reducing the number of switch failures.

Many in-tie switch machines include a rotatable hand crank mechanism which enables manual operation of the switch machine and a power cut off switch for turning off power to the switch machine motor. Such hand crank mechanisms, however, are small and require that an operator rotate the hand crank numerous times in order to move the switch points to a desired end position. In some cases, up to one hundred turns or more of the hand crank are required to move the switch points from one position to another, thus requiring a substantial amount of time and effort on the part of an operator. This is undesirable during normal train operation which requires that the switch points be quickly moved so that the train is not stopped for a significant amount of time. As such, hand cranks found on in-tie switch machines are suitable for performing installation and maintenance procedures associated with the switch machine but are not suitable for moving the switch points from one position to another during normal operations.

Further, the hand crank and cut off switch may be located in areas of an in-tie switch machine that provide limited access for the operator thus making operation of the hand crank and cut off switch difficult. The operator must also ensure that rotation of the hand crank is not hindered or blocked by track ballast, debris or other interfering item.

Therefore, there is a need for a mechanism for an in-tie switch machine that enables manual control of the switch machine and requires minimal time and effort to operate.

SUMMARY OF THE INVENTION

A hand throw mechanism for an in-tie switch machine is disclosed. The mechanism includes an elongated hand throw arm having a first coupling element that includes a first lower mating surface and a first upper mating surface. The mechanism also includes a gear set having an output shaft for moving the drive element. The gear set additionally includes a second coupling element having a second lower mating surface for engaging the first upper mating surface and a second upper mating surface for engaging the first lower mating surface to thus couple the first and second coupling elements. Rotation of the hand throw arm through an angle of approximately 180 degrees then causes rotation of the output shaft to thus move a driving element in the in-tie switch machine which ultimately moves the switch points from one locked end position to an opposite locked end position. The mechanism also includes a thrust element having a raised portion wherein rotation of the thrust element urges the raised portion against the first coupling element to separate the first and second coupling elements and disengage the hand throw arm.

DESCRIPTION OF THE INVENTION

Figure 1:
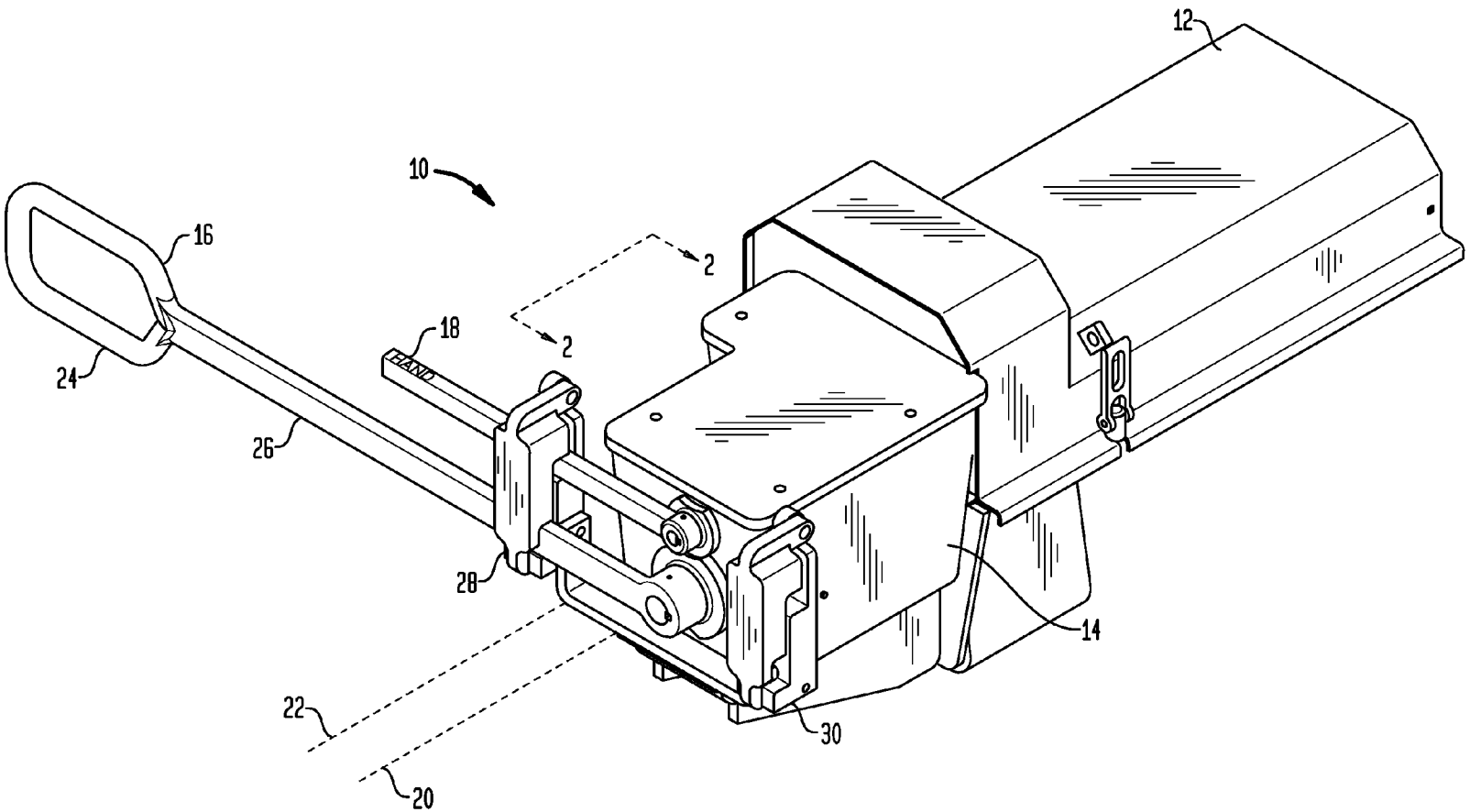
FIG. 1 is a perspective view of a hand throw mechanism in accordance with the present invention for use with an in-tie switch machine.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass direct and indirect mountings, connections, supports, and couplings. Further, "connected" and "coupled" are not restricted to physical or mechanical connections or couplings. In the description below, like reference numerals and labels are used to describe the same, similar or corresponding parts in the several views of FIGS. 1-6.

Referring to FIG. 1, a hand throw mechanism 10 for use with an in-tie switch machine 12 is shown. The mechanism 10 enables manual operation of the switch machine 12 in case a power outage, loss of communication or other situation occurs where motorized operation of the switch machine 12 is not available. The mechanism 10 includes a housing 14 and a hand throw arm 16 for moving a pair of switch points. The mechanism 10 also includes a selector lever 18 for turning power to the switch machine 12 on and off via couplings and linkages between selector lever 18 and cut off switch located inside in-tie switch machine 12 as will be described. The sequence of operation for the hand throw arm 16 and selector lever 18 is well known in the industry and is in accordance with American Railway Engineering and Maintenance-of-Way Association (AREMA) requirements. Thus, railroad personnel do not require retraining in order to operate the mechanism described herein.

The hand throw arm 16 and selector lever 18 are rotatable about first 20 and second 22 axes, respectively, and both are rotatable through an arc of approximately 180 degrees in either clockwise and counterclockwise directions. In a first position, the hand throw arm 16 and selector lever 18 extend to the left as shown in FIG. 1. In a second position, the hand throw arm 16 and selector lever 18 are oriented approximately 180 degrees from the first position and extend to the right. Placement of the hand throw arm 16 in the first and second positions corresponds to placement of the switch points in first and second end positions, respectively. The hand throw arm 16 includes a head portion 24 for facilitating manipulation of the hand throw arm 16 by an operator and an extended middle portion 26 for providing leverage when rotating the hand throw arm 16 between the first and second positions. The mechanism 10 also includes integral left 28 and right 30 latch stands for locking the hand throw arm 16 and selector lever 18 in either the first or second positions.

The mechanism 10 is adaptable for use with any type of in-tie switch machine 12 that is configured to move switch points between first and second end positions in order to switch a train from one railroad track to another railroad track. The switch machine 12 is of the type where many of the various mechanisms and components used in moving switch points, such as a switch machine, pawl lock, throw and detector rods and others are housed in a single compartment which also serves as a railroad tie. In addition, the switch machine 12 is motorized and may be controlled from a remote location. In one embodiment, mechanism 10 may be used in conjunction with a Switchguard® 3700V Point Machine switch mechanism sold by Siemens.

Figure 2:
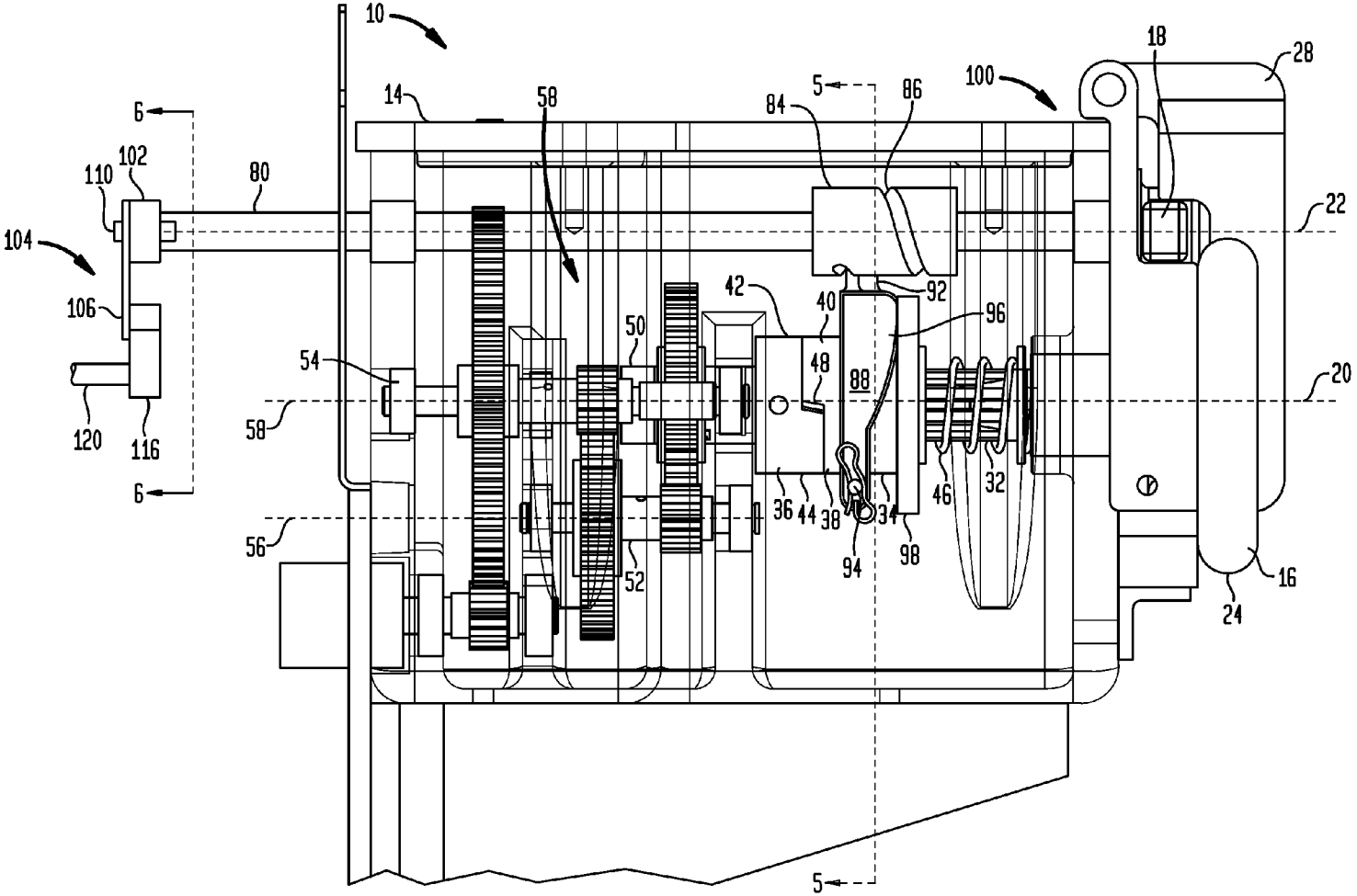
FIG. 2 is a left side view of the mechanism along view line 2-2 shown with a portion of the housing 14 removed.
Figure 2A:
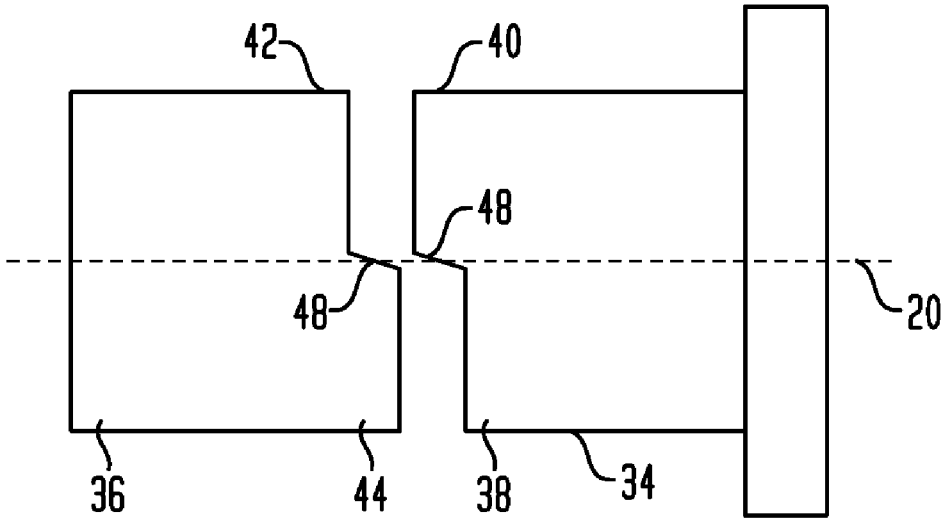
FIG. 2*a* depicts an alignment of right and left couplings prior to engagement.

Referring to FIG. 2, a left side view of the mechanism 10 along view line 2-2 of FIG. 1 is shown with a portion of the housing 14 removed. The mechanism 10 includes a hand throw shaft 32 that is rotatable about the first axis 20 and is attached between the hand throw arm 16 and a right coupling 34. The mechanism 10 also includes a left coupling 36 that is rotatable about the first axis 20. The right coupling 34 includes a first lower mating surface 38 and a first upper mating surface 40. The left coupling 36 includes a second lower mating surface 42 and a second upper mating surface 44. In order to engage the right 34 and left 36 couplings, the first lower mating surface 38 is aligned with the second upper mating surface 44 and the first upper mating surface 40 is aligned with the second lower mating surface 42 as shown in FIG. 2*a*. Once aligned, such as when the hand throw arm 16 is in the first position and the switch points are in the first end position, the first lower mating surface 38 abuts the second upper mating surface 44 and the first upper mating surface 40 abuts the second lower mating surface 42 as shown in FIG. 2, thus engaging the right 34 and left 36 couplings. Once engaged, the first upper mating surface 40 is located directly above the second upper mating surface 44. When the right coupling 34 is rotated by rotating the hand throw arm 16, the first upper mating surface 40 abuts the second upper mating surface 44 which then causes corresponding rotation of the left coupling 36. The right coupling 34 is urged against the left coupling 36 by a spring 46. In addition, edges 48 of the first 40 and second 44 upper mating surfaces are beveled in order to facilitate engagement of the right 34 and left 36 couplings.

Figure 3:
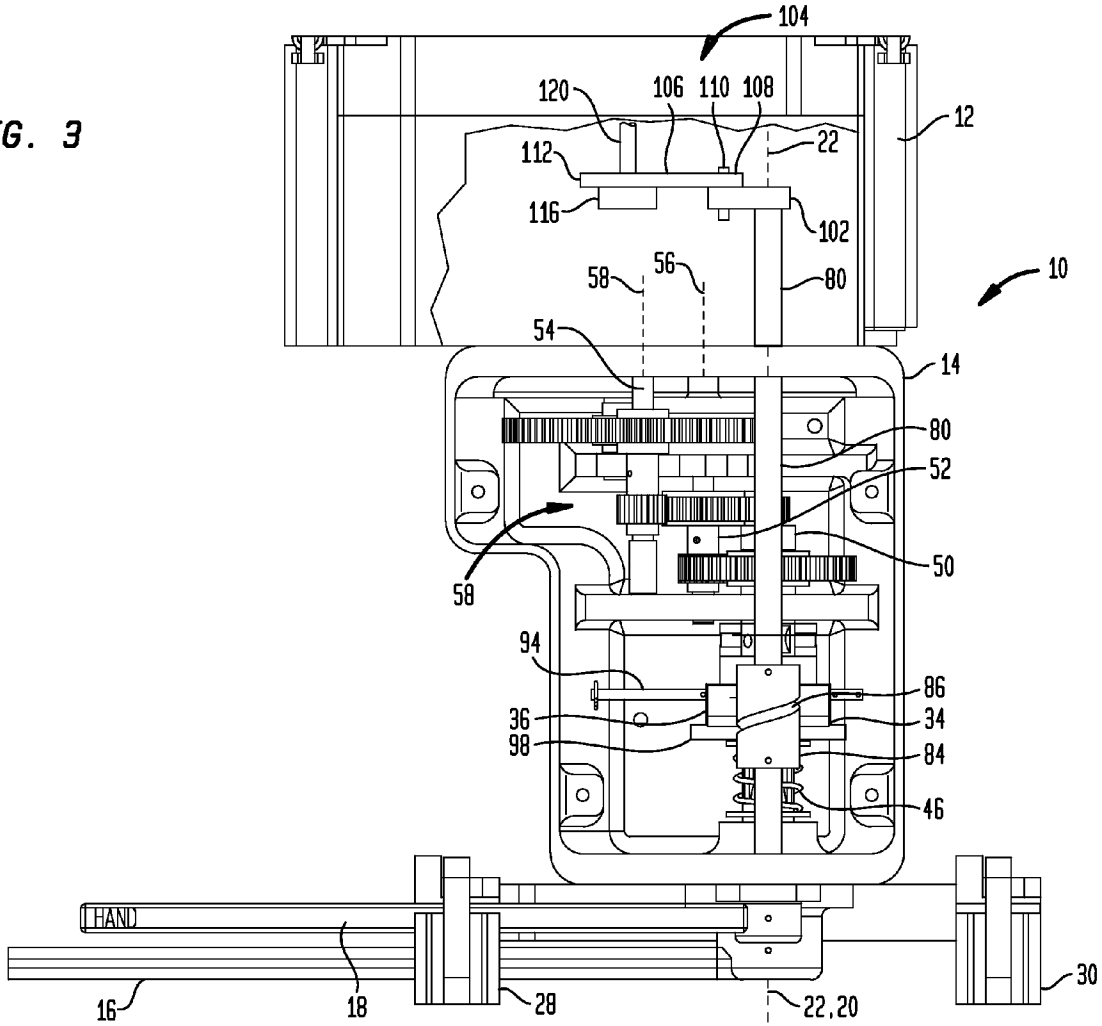
FIG. 3 is a top view of the mechanism 1 shown with a cover plate removed.

Referring to FIG. 3, a top view of the mechanism 10 is shown with a cover plate removed. The mechanism 10 includes input 50, intermediate 52 and output 54 shafts that rotate about the first axis 20 and third 56 and fourth 58 axes, respectively. The input 50, intermediate 52 and output 54 shafts include a plurality of spur gears which form a gear set 58. Referring to FIG. 3 in conjunction with FIG. 2, the input shaft 50 is attached to the left coupling 36 and the output shaft 54 is coupled to a drive element located in the switch machine 12 which is adapted to move the switch points to an end position. In particular, the drive element in the switch machine 12 may be any type of device, such as a ball spindle arrangement, which is able to convert rotational motion from the output shaft 54 to linear motion for moving the switch points to an end position.

Figure 4:
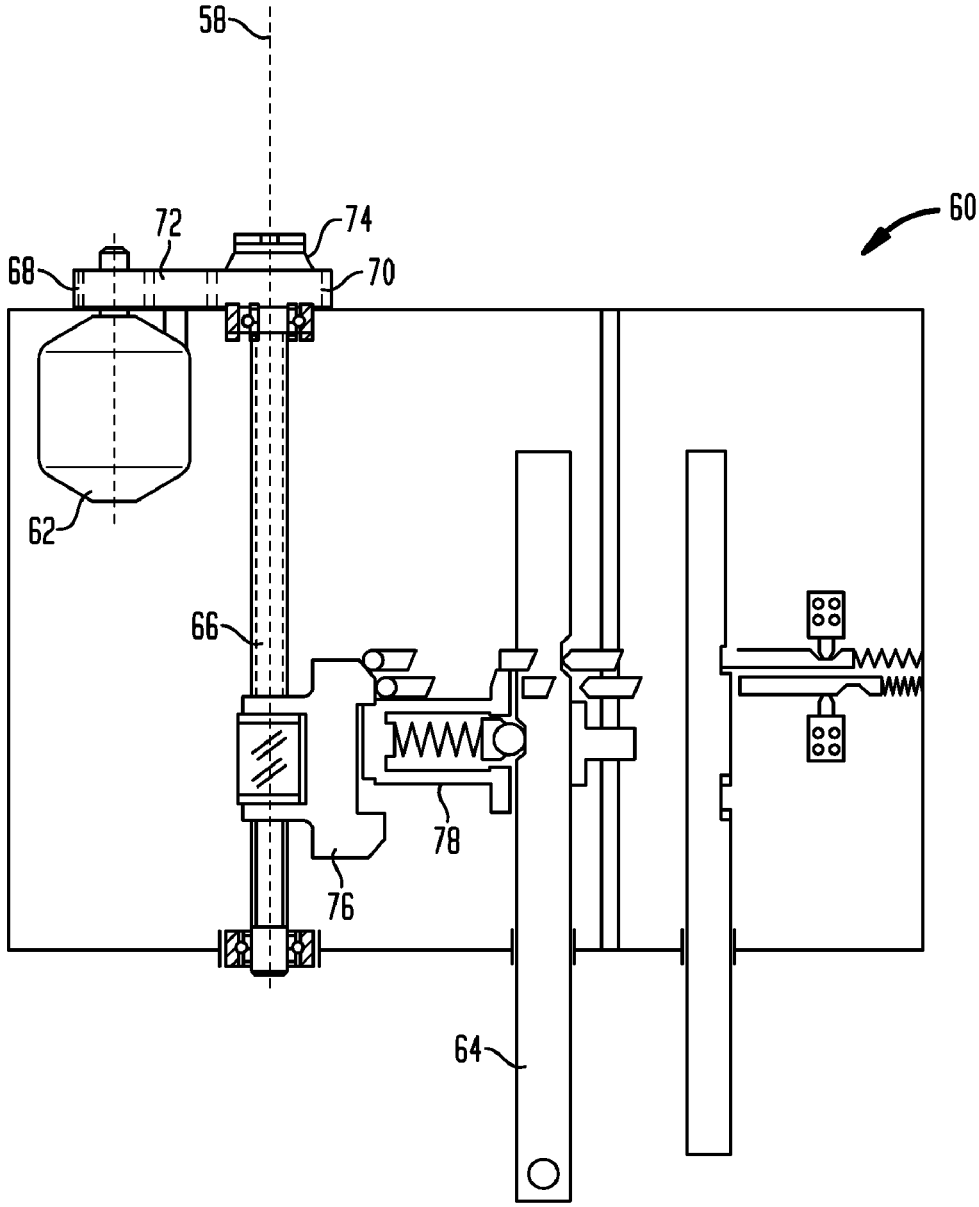
FIG. 4 is a functional schematic of an exemplary in-tie switch machine.

Referring to FIG. 4, a functional schematic of an exemplary in-tie switch machine 60 is shown. The in-tie switch machine 60 includes a motor 62 and a moveable throw bar 64 operatively connected to the switch points. A ball spindle 66 of the in-tie switch machine 60 is coupled to the output shaft 54 (see FIG. 2) and thus also rotates about the second axis 58. The ball spindle 66 may be rotated either by the motor 62 or the hand throw arm 16. A shifting plate 76 is threadably engaged to the ball spindle 66. The ball spindle 66 and shifting plate 76 serve as the drive element coupled to the output shaft 54 for converting rotational motion to linear motion as described in connection with FIG. 3.

During motorized operation, the hand throw arm 16 is disconnected from the gear set 58 as will be described. The motor 62 then rotates a pinion gear 68 which rotates a gear 70 via an intermediate gear 72. The rotational motion is then transmitted to the ball spindle 66 via a transmission clutch 74. Rotation of the ball spindle 66 then causes linear motion of the shifting plate 76 along the second axis 58. The linear motion is transmitted by a retention clutch mechanism 78 to the throw bar 64 which thus causes movement of the switch points to an end position.

When power to the motor 62 is cut off, the hand throw arm 16 may then be engaged with the gear set 58 as will be described. Rotational motion of the hand throw arm 16 is then transmitted to the output shaft 54 of the gear set 58 which causes rotation of the ball spindle 66, linear motion of the shifting plate 76 and the throw bar 64 to move the switch points to an end position as described above.

Referring back to FIG. 2, a gear ratio of the gear set 58 is selected such that rotation of the left coupling 36 through an angle of approximately 180 degrees causes a rotation of the output shaft 54 suitable for moving the switch points to either the first or second end position. In one embodiment, an approximately 180 degree rotation causes approximately 50 rotations of the output shaft 54. As such, the range of rotation of the hand throw arm 16 when the right 34 and left 36 couplings are engaged is also approximately 180 degrees. For example, rotation of the hand throw arm 16 to the second position rotates the right 34 and left 36 couplings such that they are in an inverted position wherein the second upper mating surface 44 is located above the first upper mating surface 40 and indicating that the switch points are in the second end position. Thus, rotation of the hand throw arm 16, when the right 34 and left 36 couplings are engaged, through an arc of approximately 180 degrees between the first and second positions causes rotation of the gear set 58 and ultimately moves the switch points to either the first or second end position. As a result, minimal rotation of the hand throw arm 16 is required to move the switch points from one end point to another end point, thus substantially reducing the amount of time and effort required by an operator to manually operate the switch machine 12.

Figure 6:
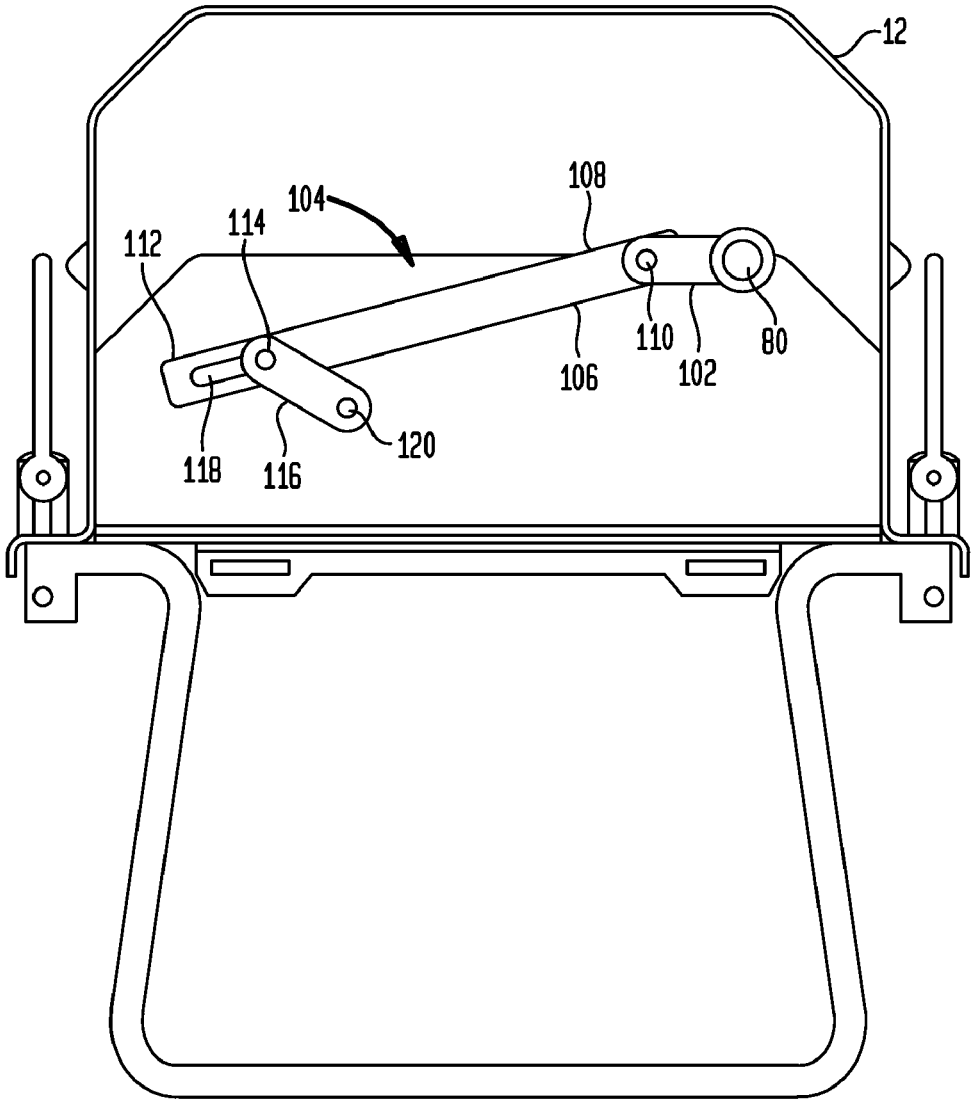
FIG. 6 depicts a linkage mechanism for connecting a selector lever to a motor cut off switch.

The selector lever 18 is connected to a selector lever shaft 80 which rotates about the second axis 22. The selector lever shaft 80 includes a cam 84 having a spiral slot 86 and a shaft coupling 102 which rotate in unison with the selector lever shaft 80. Referring now to FIG. 6, a view along view line 6-6 of FIG. 2 is shown which depicts a linkage mechanism 104 for connecting the selector lever shaft 80 to a rotary cut off switch for turning power to the motor 62 on or off. The linkage mechanism 104 includes an intermediate linkage 106 having a first end 108 which is rotatably attached by a first pivot element 110 to the shaft coupling 102. A second end 112 of the intermediate linkage 106 includes a slot 118 for receiving a second pivot element 114 which rotatably connects a motor linkage 116 to the intermediate linkage 106. The slot 118 also enables translational movement of the intermediate linkage 106. The motor linkage 116 includes an attachment element 120 for attaching the motor linkage 116 to a rotary cut off switch for turning power to the motor 62 on or off. The linkage mechanism 104 is configured such that an approximately 180 degree rotation of the selector lever 18 ultimately causes rotation of the motor linkage 116 to thus turn the rotatory cut off switch and turn the motor 62 on or off as desired. As will be appreciated, the linkage mechanism 104 may also be adapted to actuate other types of switches other than a rotary switch.

When the selector lever 18 is in the first position as shown in FIGS. 1 and 2, the motor 62 is turned off and the right 34 and left 36 couplings are engaged as described in relation to FIGS. 1 and 2 thus engaging the hand throw arm 16. This enables manual operation of the switch machine 12 (i.e. denoted by "HAND" on the selector lever 18). The hand throw arm 16 may then be rotated so as to move the switch points to a desired end position.

Figure 5:
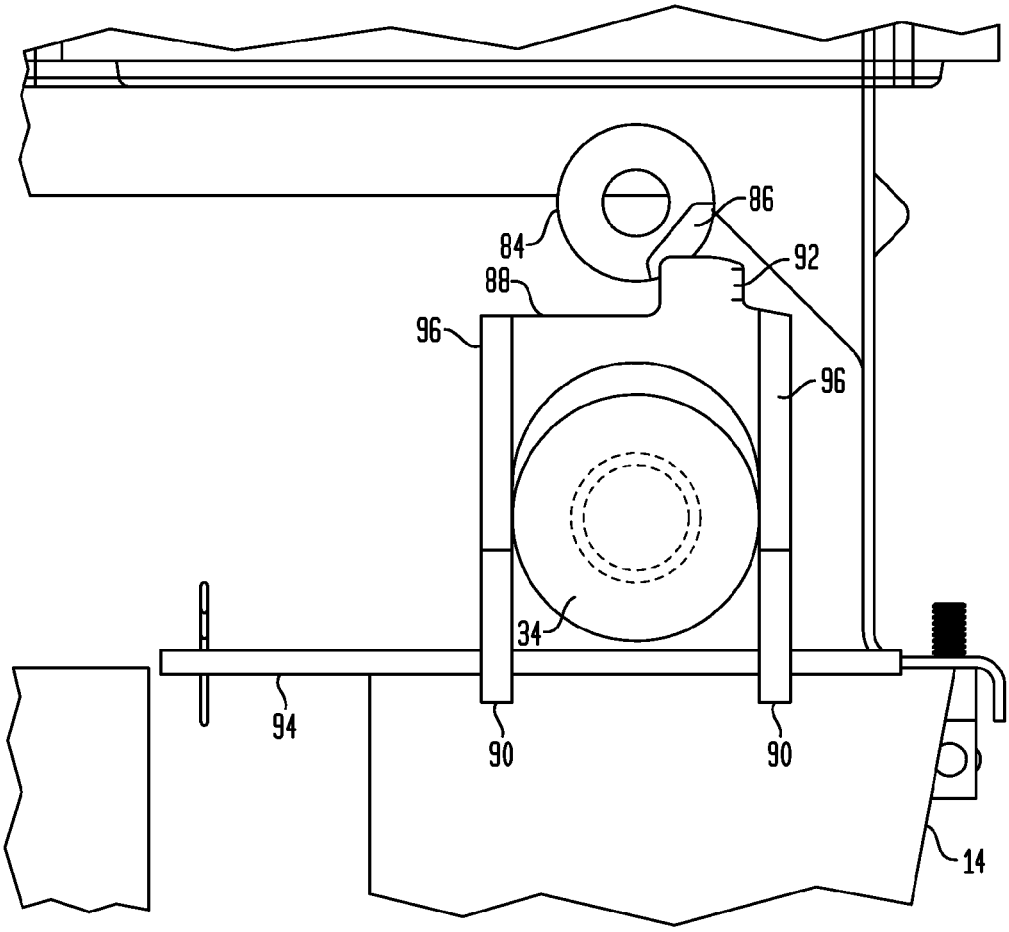
FIG. 5 is a partial cross sectional view along view line 5-5 of FIG. 2 and depicts a thrust element and the right coupling.

FIG. 5 is a partial cross sectional view along view line 5-5 of FIG. 2. Referring to FIG. 5 in conjunction with FIG. 2, the mechanism 10 further includes a thrust element 88 having spaced apart prongs 90 to form an inverted U-shape. The right coupling 34 is located between the prongs 90. A top portion of the thrust element 88 includes an upwardly projecting guide element 92 which engages the spiral slot 86 in the cam 84. The prongs 90 are rotatably attached to a thrust element shaft 94 which extends horizontally from the housing 14 and is located underneath the right coupling 34. The prongs 90 also include raised portions 96 which abut against a flange 98 on the right coupling 34.

Rotation of the selector lever 18 from the first position to the second position (i.e. denoted by "MOTOR" on selector lever 18) causes the cam 84 to rotate thus engaging the spiral slot 86 and the guide element 92. The spiral slot 86 and guide element 92 are configured such that when the selector lever 18 is rotated to the second position the thrust element 88 is urged toward a front section 100 of the housing 14. The thrust element 88 then pivots in a clockwise direction thus pushing the raised portions 96 against the flange 96. This causes disengagement of the right 34 and left 36 couplings, thus also disengaging the hand throw arm 16. Further, rotation of the selector lever 18 to the second position also turns the motor 62 on to thus provide normal motorized operation of the switch machine 12.

Rotation of the selector lever 18 back to the first position then causes the cam 84 to engage the spiral slot 86 to pivot the thrust element 88 in a counterclockwise direction. The right coupling 34 is then urged toward the left coupling 36 by the spring 46 to enable engagement of the right 34 and left 36 couplings once the couplings 34, 36 are aligned as previously described. In addition, the motor 62 is also turned off when the selector lever 18 is in the first position as previously described.

While the invention has been described in conjunction with specific embodiments, it is evident that many alternatives, modifications, permutations and variations will become apparent to those skilled in the art in light of the foregoing description. Accordingly, it is intended that the present invention embrace all such alternatives, modifications and variations.

What is claimed is:

1. A hand throw mechanism for an in-tie switch machine having a drive element for moving switch points from a first end point to a second end point, comprising:

an elongated hand throw arm having a first coupling element which includes a first lower mating surface and a first upper mating surface; and a gear set having an output shaft for moving the drive element, the gear set also including a second coupling element which includes a second lower mating surface that engages the first upper mating surface and a second upper mating surface that engages the first lower mating surface to couple the first and second coupling elements wherein an approximate 180 degree rotation of the hand throw arm causes rotation of the first and second couplings, the gear set and the output shaft to thus move the drive element and the switch points.

2. The mechanism according to claim 1, wherein a gear ratio of the gear set is selected such that an approximate 180 degree rotation of the hand throw arm corresponds to moving the switch points from the first end point to the second end point.

3. The mechanism according to claim 1, wherein the first coupling element is urged to the second coupling element by a spring.

4. The mechanism according to claim 1, wherein the drive element converts rotational motion to linear motion.

5. The mechanism according to claim 1, wherein the drive element is a ball spindle arrangement.

6. The mechanism according to claim 1, wherein the gear set includes spur gears.

7. A hand throw mechanism for an in-tie switch machine having a drive element for moving switch points from a first end point to a second end point, comprising:

an elongated hand throw arm having a first coupling element which includes a first lower mating surface and a first upper mating surface;

a gear set having an output shaft for moving the drive element, the gear set also including a second coupling element which includes a second lower mating surface that engages the first upper mating surface and a second upper mating surface that engages the first lower mating surface to couple the first and second coupling element wherein an approximate 180 degree rotation of the hand throw arm causes rotation of the first and second couplings, the gear set and the output shaft to thus move the drive element and the switch points; and a rotatable thrust element having a raised portion wherein rotation of the thrust element urges the raised portion against the first coupling element to separate the first and second coupling elements and disengage the throw arm.

8. The mechanism according to claim 7, wherein a gear ratio of the gear set is selected such that an approximate 180 degree rotation of the hand throw arm corresponds to moving the switch points from the first end point to the second end point.

9. The mechanism according to claim 7, wherein the first coupling element is urged to the second coupling element by a spring.

10. The mechanism according to claim 7, wherein the drive element converts rotational motion to linear motion.

11. The mechanism according to claim 7, wherein the drive element is a ball spindle arrangement.

12. The mechanism according to claim 7, wherein the gear set includes spur gears.

13. The mechanism according to claim 7, wherein the thrust element has an inverted U-shape to form prongs which include the raised portion.

14. The mechanism according to claim 13, wherein the first coupling element is located between the prongs.

15. A hand throw mechanism for an in-tie switch machine having a drive element for moving switch point tracks from a first end point to a second end point, comprising:

an elongated hand throw arm having a first coupling element which includes a first lower mating surface and a first upper mating surface;

a gear set having an output shaft for moving the drive element, the gear set also including a second coupling element which includes a second lower mating surface that engages the first upper mating surface and a second upper mating surface that engages the first lower mating surface to couple the first and second coupling element wherein an approximate 180 degree rotation of the hand throw arm causes rotation of the first and second couplings, the gear set and the output shaft to thus move the drive element and the switch points;

a rotatable thrust element having a raised portion wherein rotation of the thrust element urges the raised portion against the first coupling element to separate the first and second coupling elements and disengage the throw arm; and a selector lever having a cam device for rotating the thrust element to separate the first and second coupling elements for enabling motorized operation of the in-tie switch machine.

16. The mechanism according to claim 15, wherein a gear ratio of the gear set is selected such that an approximate 180 degree rotation of the hand throw arm corresponds to moving the switch points from the first end point to the second end point.

17. The mechanism according to claim 15, wherein the drive element converts rotational motion to linear motion.

18. The mechanism according to claim 15, wherein the drive element is a ball spindle arrangement.

19. The mechanism according to claim 15, wherein the thrust element includes a guide element for engaging a slot formed in the cam device.

20. The mechanism according to claim 15, wherein rotation of the selector lever causes the cam device to rotate the thrust element to engage the first and second coupling elements.

* * * * *